United States Patent [19]

Killman

[11] Patent Number: 4,978,249

[45] Date of Patent: Dec. 18, 1990

[54] SAFE, FLUID-STORAGE SYSTEM

[76] Inventor: Troy H. Killman, HC 75 Box 2825, Camp Verde, Ariz. 86322

[21] Appl. No.: 323,504

[22] Filed: Mar. 14, 1989

[51] Int. Cl.[5] ..... B65D 25/00

[52] U.S. Cl. ..... 405/303; 405/53; 405/54

[58] Field of Search ..... 405/53, 54, 303; 73/49.2 T; 220/18

[56] References Cited

U.S. PATENT DOCUMENTS

| | | | |
|---|---|---|---|
| 4,366,846 | 1/1983 | Curati | 405/53 X |
| 4,638,920 | 1/1987 | Goodhues | 73/49.2 T X |
| 4,639,164 | 1/1987 | Pugnale et al. | 405/54 |
| 4,655,361 | 4/1987 | Clover et al. | 220/18 X |
| 4,787,772 | 11/1988 | Wagner | 405/53 |
| 4,818,151 | 4/1989 | Moreland | 405/303 |

*Primary Examiner*—David H. Corbin

*Attorney, Agent, or Firm*—James F. Duffy

[57] ABSTRACT

A system for the safe storage of fluids, such as fuels or other toxic materials. A fluid storage tank is accessibly housed within a water tight, reinforced concrete, underground compartment. Piping and electrical lines run through an accessible, water tight chase in communicating with the storage tank, its housing compartment, fluid pumps, sensors, alarms, and fire extinguishing systems. Free access to the tank within its housing compartment is available so that the tank and its compartment may be inspected and maintained. Because the tank is not buried in gravel or the like, its replacement is a relatively simple and inexpensive task. Fluids which are spilled or leaked, including washdown fluids are recovered for proper disposal. Local seismic conditions are considered in the design of the reinforced concrete housing to assure against cracking and resultant leakage through the walls and floors of the housing.

8 Claims, 2 Drawing Sheets

SAFE, FLUID-STORAGE SYSTEM

BACKGROUND

1. Field of the Invention

The invention relates to the storage of fluids which have potential for polluting the environment. In particular, the invention relates to means for accessibly storing such fluids in an underground storage tank such that regular inspection and maintenance of the storage tank may take place and having means for preventing any fluid leakage from the tank from entering the environment.

2. Prior Art

The invention is directed to the safe storage of liquids which if loosed into the environment could pollute and possibly produce toxic effects. Insight into the problem was first garnered from investigations of present day methods for storing gasoline at automobile service stations. The gasoline storage tanks at these stations are buried underground. In the emplacement of these storage tanks, an excavation is made in the earth and a bed of gravel is laid down. The storage tank is emplaced upon the bed of gravel and additional gravel is placed about it to support it and the weight of the gasoline which it will store. Piping to convey gasoline to and from the tank is buried as well. There is, of course, an injection port, accessible from above ground, into which the gasoline fuel is injected in filling the tank.

So stored, the gasoline storage tank is subject to the deterioration both from without and within. Water accumulating within the gasoline storage tank along its lower-most surfaces tends to rust the tank from the inside. Environmentally derived liquids attack the tank from without. Often, sooner than expected, the storage tank may spring a leak. The leak may initially be so small as to prove unnoticeable, yet gasoline is leaking into the ground and finding its way into ground water flow and aquifers. In the past, when such leakage was discerned, it was often allowed to continue. Such decisions were predicated upon the high cost of excavating the gasoline storage tanks and replacing them.

In U.S. Pat. Nos. 4,682,911 and 4,778,318 issued to J. Moreland, the use of a plastic membrane to form a catch basin into which spilled or leaking gasoline will accumulate and from which the accumulated gasoline may be withdrawn is disclosed. In the '911 patent, Moreland makes an excavation for the gasoline storage tanks in a manner similar to that done in the prior art. The excavation is then lined with a membrane and the membrane-lined excavation is partially filled with gravel to form the base for the tank. As before, more gravel is provided until the tank is totally surrounded by this material. Moreland, in his disclosure, notes that the membrane is subject to pinhole damage. Thus, gasoline leaking from the tank can find its way past the membrane and into the earth and the water systems therein. This would be especially true if pinhole damage occurred at the lowermost regions of the membrane lined excavation. In addition, a ruptured storage tank, even though surrounded by Moreland's membrane, must still be dug up in order to be replaced. Such excavation procedures are singularly expensive.

It is an object of the present invention that liquid storage tanks, for example, gasoline storage tanks, will remain readily accessible for inspection and maintenance even though emplaced beneath the ground surface. It is further desired of the invention that the need for expensive excavation in order to replace a damaged storage tank will be obviated. In addition to accessibility for visual and tactile inspection techniques, the invention has as an objective the use of sensors to detect abnormal conditions as well as providing the means for assisting in the extinguishing of fires fed by the fluids stored within the tank or adjacent combustible materials.

SUMMARY OF THE INVENTION

The invention is disclosed and claimed as an improvement in a fluid-storage system. The system improved upon is one which has a fluid storage tank which is subject to deterioration and damage which can result in the escape from the tank of fluids stored therein, the escape of such fluid, liquid or gaseous, being detrimental to the environment. The prior art system to be improved upon also includes fluid distribution lines for conveying fluid to and from the storage tank. There are also pumping means to aid in the conveyance of the fluids through the distribution lines.

The improvement is claimed as an underground structure of water tight construction housing a storage tank. The water tight structure includes a water tight access to provide convenient personnel access to the interior of the structure as well as to the storage tank. Fluid leak-detection sensors are emplaced within the underground structure to detect leaks, turn off pumps, isolate the storage tank and signal an alarm when a leak is detected.

A fire sensing and extinguishing system is at least partially housed within the underground structure to detect fires, turn off pumps, and activate means for extinguishing such fires. As an aid to the local fire fighting units in the area, there are provided conduits which terminate openly within the underground structure and which have coupling means at a remote exterior end of the storage system so that the fire fighters may therein inject fire extinguishing materials at a distance which is safe and remote from any fire within the underground structure.

Unlike prior art systems which embed and support the storage tank within a surround of gravel, the improved system supports the tank on mounting blocks within the underground structure. Personnel entering the structure, via the access means, may readily inspect the tank for leakage, making any necessary repairs, and applying protective coatings to the surface of the tank as may be deemed appropriate. Because the storage tank is so accessible within the underground structure, access is provided to the structure to provide the ready, economical emplacement and replacement of a storage tank within the underground structure.

The improved system also has an underground chase structure which is coupled to the underground structure that houses the storage tank. The chase structure has fluid and electrical lines therein which communicate with the underground structure housing the tank. The underground chase structures are so designed that any fluid leakage therein will flow from the chase structure and into the underground structure housing the tank. Just as the underground housing structure had means to allow personnel access thereto, so too does the chase structure provide access to personnel for inspection, maintenance and repair within the chase.

A problem experienced in the prior art systems is that of spillage resulting when fluids are conveyed into the storage tank. In the present, improved system, such spillage is accumulated and conveyed to the storage tank. To prevent contamination of fluids directly injected into the storage tank, the return spillage fluids are first filtered. A washdown system is provided so that spillage occasioned by filling the storage tank may be cleaned as well. Because such washwater will become contaminated with any of the fluids which have spilled while filling the tank, a wash recovery system is also provided to draw off the accumulated, and contaminated wash fluids.

There are sumps within the underground housing structure for collecting any fluids which may leak from the storage tank or its associated fluid conveyance lines. A system is provided for suctioning off fluids which accumulate within the sump.

Care is used in the construction of the underground structure to maintain it water tight and to prevent cracks from occurring in the concrete of which the structure is formed. To this end the structure is designed to meet seismic load limits established for the area in which the structure is emplaced.

Within the storage tank, contaminating fluids often accumulate within a segregated layer within the stored fluid. A typical example of this is water which accumulates at the bottom of a gasoline storage tank. The improved system provides a means for drawing off fluid from such a segregated layer. This improves the quality of the fluids disbursed from the tank and frequently will prevent deterioration of the tank itself, for example, the elimination of a water layer will reduce the possibility of rusting of the interior surfaces of the storage tank.

A DETAILED DESCRIPTION OF THE INVENTION

Figure 1:
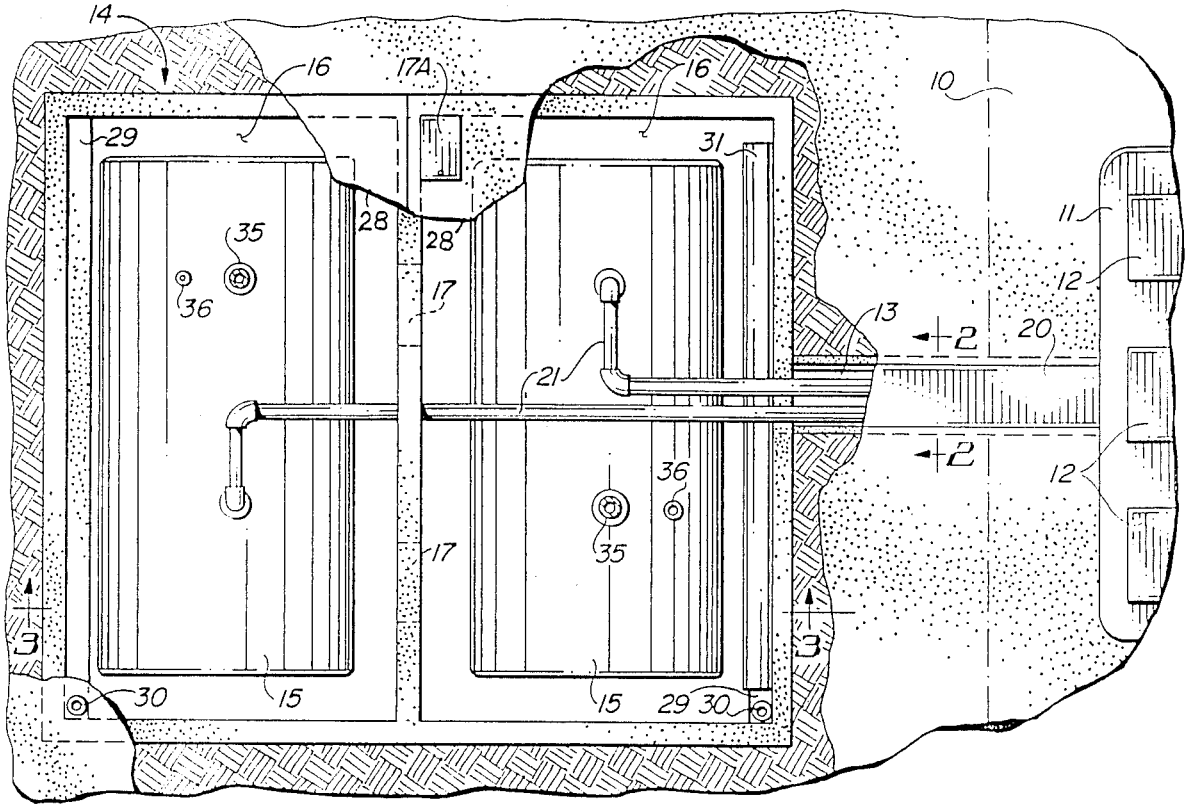
FIG. 1 is a plan view of the invention showing two fluid storage tanks stored underground in an accessible, water tight enclosure.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

In the exposition of the invention herein, the installation of fluid storage tanks for the storage of gasoline at a service station has been chosen for illustration. However, no limitation on the use of the invention is implied. For example, oil refineries have tank farms wherein the storage tanks are exposed to weathering and other damage. Frequently, an explosive accident will cause fire to rage extensively about such a tank farm. The placement of such tanks underground in water tight enclosures isolated one from another would extend the lifetime of the storage tanks and aid in inhibiting the spread of fire.

In exemplifying the invention as being used in a gasoline station, FIG. 1 is provided. Here, reference 10 indicates a gasoline service station having a service island 11 with gasoline pumps 12 thereon. A covered trench or chase 13 conveys electricity and fluids between island 11 and an accessible, underground water tight structure or enclosure 14 which houses fluid storage tanks 15.

Enclosure 14 may be made up of one or more individual tank storage compartments 16 with access portals 17 permitting personnel passage from one compartment to another. In practice, access portals 17 may be equipped with fire resistant portal closures. In the event of a fire within one of the compartments such isolation is desirable so that the site of the fire will be contained within the one compartment. Fire-fighting materials, such as Halon fire extinguishing gas or the like, may be injected into any one of the individual compartments 16, conveyed there through piping 21 carried within chase 13 and injected into such piping at a site remotely located from the storage tank enclosure 14, thus providing a margin of safety to fire fighters.

Chase 13 has walls 18 and floor 19 constructed of reinforced concrete. It is to be understood that, while not always illustrated, all joints in concrete structures utilized with the invention are sealed with cast-in-place stops, such as 25 in FIG. 5, to prevent leakage at these joints. These stops are selected from materials which will resist degradation by fuel contact.

Figure 2:
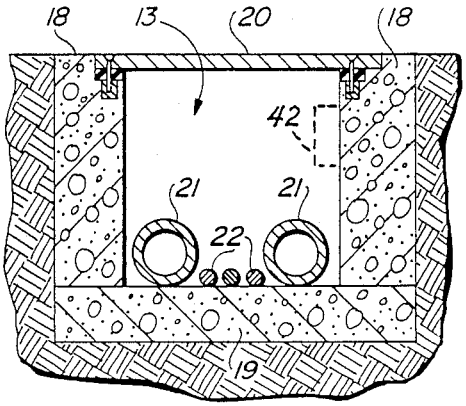
FIG. 2 is a cross sectional view of a trench or chase carrying piping and electrical lines to and from the underground chamber of FIG. 1. The sectional view is taken along line 2—2 of FIG. 1.

Chase 13, illustrated in cross section in FIG. 2, is provided with a water tight metal lid 20. The structure of chase 13 is so designed that any fluids inadvertently entering the structure will flow from the chase into a compartment 16 of enclosure 14. Chase 13 carries means for conveying fluids and electrical currents or signals. Thus piping 21 will convey fluids such as gasoline or fire-fighting gases. And cables/wires 22 will provide the means for energizing sensors and alarms utilized in the system. The use of sensors and alarms is indicated by the phantom outline 42 in FIGS. 2 and 5. Such alarms and sensors are well known in the prior art and are not detailed herein. Sensors will detect a build up of fumes within the atmosphere of compartment 16 and chase 13 which may indicate a fuel leakage. Once such a build up is detected will be secured and an alarm will be triggered to indicate the location of the sensor so that inspection may be made for a leak in that location. So too, a fire alarm will be triggered by combustion by-products and heat. This alarm will automatically activate an on-location fire extinguishing system, deemed also to be contained within phantom outline 42, turn off pumps and trigger a signal as to the location of the fire. Selected piping 21 will be dedicated to the conveyance of fire extinguishing gases or the like. Such gases will be capable of being injected into the selected piping 21 at a remote site so that the fire may be fought with safety by local fire fighters.

Figure 3:
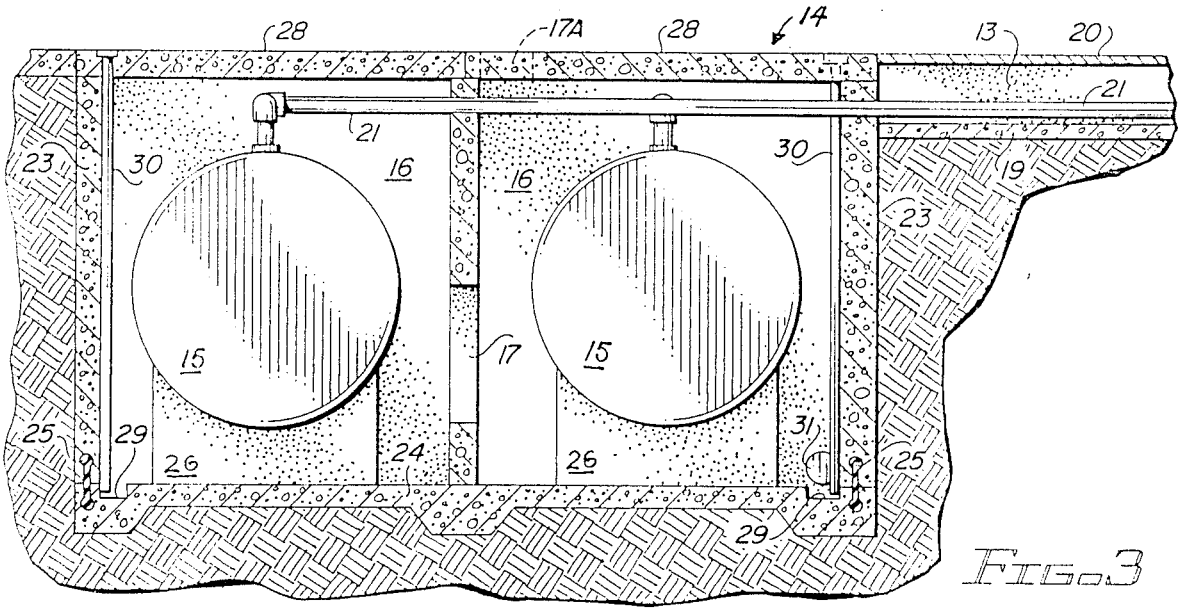
FIG. 3 is a sectional side elevation of the underground installation of fluid storage tanks within an accessible, water tight enclosure.

In the side view of the system illustrated in FIG. 3, water tight enclosure 14 is seen to be comprised of walls 23, and floors 24, and lids 28, all structured of reinforced concrete. As already noted, the joints are sealed by cast-in-place stops 25. A pre-cast lid 28 seals the enclosure. A personnel access portal 17A permits entry of persons into compartment 16 for purposes of maintenance and inspection. Access portal 17A is, of course, a water tight construct.

Figure 4:
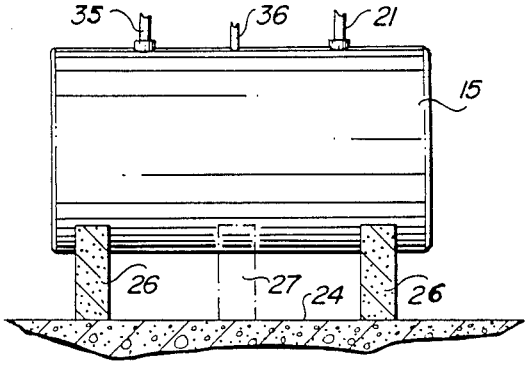
FIG. 4 illustrates the manner in which a fluid storage tank is supported so as to maximize the opportunities for inspection and maintenance of the tank.

Fluid storage tanks 15 are supported upon tank cradles 26. See the side view in FIG. 4. Additional cradle supports 27 are provided to meet the designed support requirements of the tank. Supporting the tank on cradles 26, and optionally 27, leaves much of the tank's surface exposed for inspection and maintenance. Steel tanks capable of support on such cradles are readily available and are considerably less expensive than fiberglass tanks. Because the fluid storage tanks 15 of the invention do not require a surround of gravel for support, their placement within the accessible, water tight enclosure 14 of the invention leads to an extended service life for these tanks, since they are susceptible to inspection and maintenance. Only a minimum expense is required to remove a tank from enclosure 16 for replacement, as compared to costs of replacement with systems today.

Figure 6:
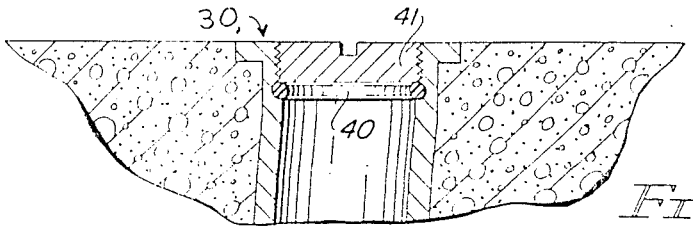
FIG. 6 is a cross sectional view indicating the type of water tight plug which may be utilized to close off fluid conveyance lines emanating from within the water tight enclosure.
Figure 5:
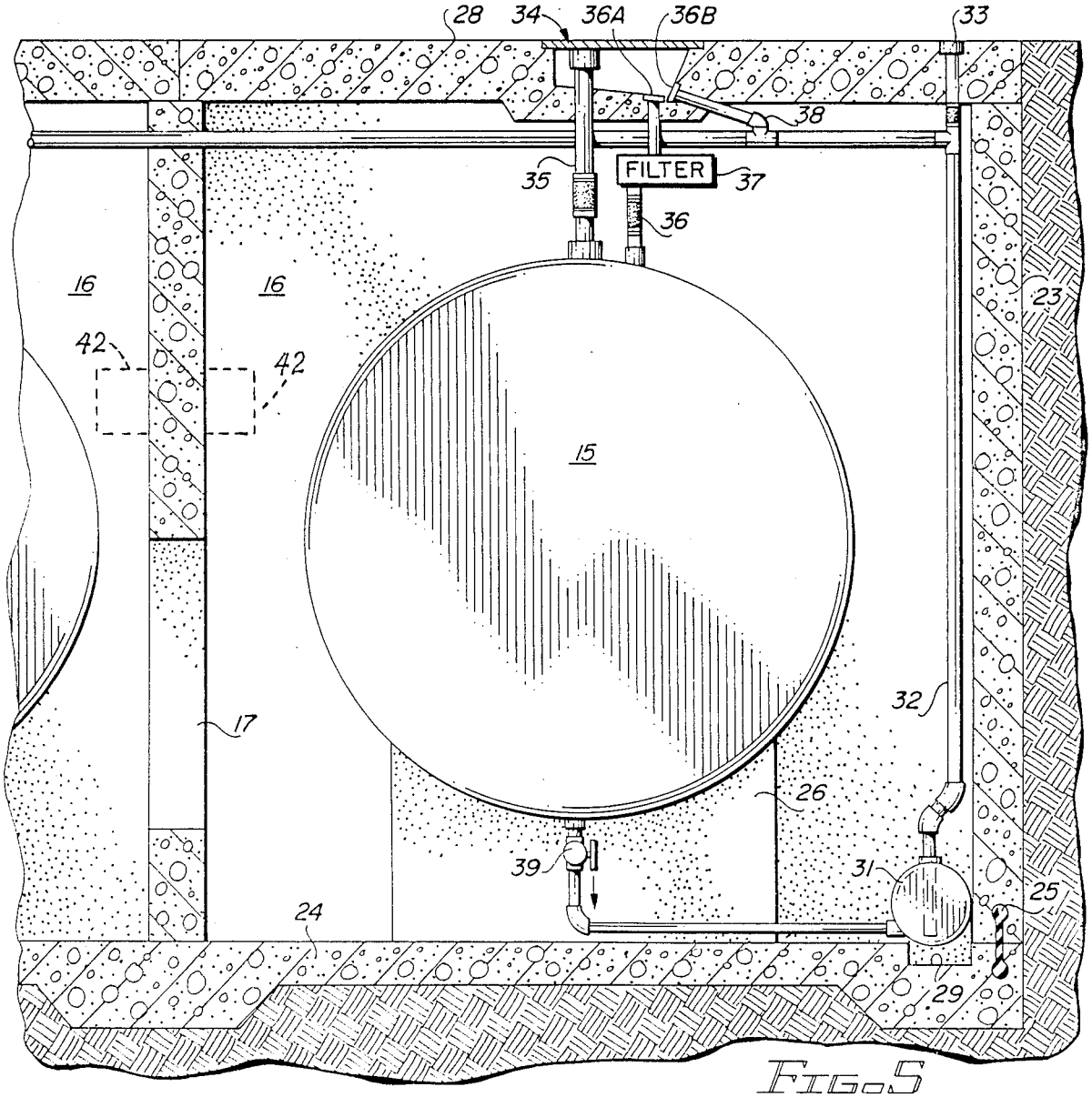
FIG. 5 is a side sectional view into the water tight enclosure showing in details of devices therein.

As seen most clearly in the side elevations of FIGS. 3 and 5, each compartment 16 is provided with a sump 29 wherein liquids leaking or spilled within the compartment will accumulate. To remove fluids accumulating within sumps 29 an extraction tube 30 extending from the sump to the surface is provided. At the surface, a water tight seal 40 is compressed by plug 41 to maintain a water tight seal at the surface entrance to extraction tube 30. See FIG. 6. In the detailed side section of FIG. 5, reinforced concrete lid 28 has a covered sump 34. Tank 15 is filled via filler tube 35. During the filling operation, a plug 41, shown in FIG. 6, is removed from spill recovery tube 36A. Thus any fuel spilled in the course of filling tank 15 is recovered in recovery tube 36A from whence it passes through filter 37 through piping 35 into tank 15. With filler tube 36 and recovery tube 36A plugged, the area may be cleaned with detergent and water. First however, a plug similar to plug 41 is removed from washwater recovery tube 36B. Washwater used to clean the area about filler tube 35 and spill recovery tube 36A will flow into washwater recovery tube 36B. Washwater recovery line 38, to all recovery tubes 36B in the system, carries the washwater recovered to a vertical pipe 32 which is in communication with a washwater storage tank 31 and with the surface at 33. The washwater accumulates in tank 31, transported there by pipe 32. When it is desired to drain the accumulated detergent, fuel, water mixture accumulated in tank 31, a plug similar to plug 41, is removed from the end 33 of pipe 32 and the mixture suctioned from tank 31, via pipe 32, and transported for proper disposal.

In the handling and shipping of gasoline, water frequently finds its way into the mass of fuel. This water and any inadvertent sediments will find their way to the lowest level of storage tank 15. A valved water drain line 39 communicating between the lowest level of tank 15 and washwater accumulation in tank 31 permits the drawing off of accumulated water from tank 15. Such procedure not only assures the quality of the fuel dispensed from tank 15 but also adds to the lifetime of tank 15 by inhibiting interior rusting.

What has been disclosed is a system for the safe storage of fluids, such a fuels or other toxic materials. A fluid storage tank is accessibly housed within a water tight underground compartment. Piping and electrical lines run an accessible, water tight chase in communicating with the storage tank, its housing compartment, fluid pumps, sensors, alarms, and fire extinguishing systems. Free access to the tank within its housing compartment is available so that the tank and its compartment may be inspected and maintained. Because the tank is not buried in gravel or the like, its replacement is a relatively simple and inexpensive task. Fluids which are spilled or leaked, including washdown fluids are recovered for proper disposal. Local seismic conditions are considered in the design of the reinforced concrete housing to assure against cracking and resultant leakage through the walls and floors of the housing.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, That which is claimed is:

1. In a fluid-storage system having a fluid storage tank subject to such deterioration and damage as to permit the escape from said tank of fluid stored therein, to the detriment of the environment; fluid distribution lines for conveying fluid to and from said storage tank; and pumping means to aid in the conveyance of said fluid through said distribution lines, the improvement comprising:

an underground structure of water tight construction housing said storage tank;

water tight access means coupled to said underground structure for providing access to said storage tank; and said water tight access means comprises both a convenient personnel access to the interior of said structure and said storage tank, and a lid for the ready, economical emplacement and replacement of said storage tank in said underground structure without excavation of said structure.

2. The improvement of claim 1 wherein said underground structure further includes spillage return means for conveying to said storage tank fluids spilled while filling said storage tank.

3. The improvement of claim 2 wherein said spillage return means further comprises filter means for filtering any spill fluids prior to conveying said spilled fluids to said storage tank.

4. The improvement of claim 1 wherein said underground structure further comprises a fluid accumulation sump for accumulating any leakage fluids from said tank and said fluid distribution lines.

5. In a fluid-storage system having a fluid storage tank subject to such deterioration and damage as to permit the escape from said tank of fluid stored therein, to the detriment of the environment; fluid distribution lines for conveying fluid to and from said storage tank; and pumping means to aid in the conveyance of said fluid through said distribution lines, the improvement comprising:

an underground structure of water tight construction housing said storage tank;

water tight access means comprising a lid coupled to said underground structure for providing access to said storage tank for the ready, economical emplacement and replacement of said storage tank in said underground structure without excavation of said structure.

6. The improvement of claim 5 wherein said underground structure further includes spillage return means for conveying to said storage tank fluids spilled while filling said storage tank.

7. The improvement of claim 6 wherein said spillage return means further comprises filter means for filtering any spill fluids prior to conveying said spilled fluids to said storage tank.

8. The improvement of claim 5 wherein said underground structure further comprises a fluid accumulation sump for accumulating any leakage fluids from said tank and said fluid distribution lines.

* * * * *